US009919521B2

(12) United States Patent
Nakamura et al.

(10) Patent No.: US 9,919,521 B2
(45) Date of Patent: Mar. 20, 2018

(54) LIQUID EJECTION HEAD

(71) Applicant: CANON KABUSHIKI KAISHA, Tokyo (JP)

(72) Inventors: Yohei Nakamura, Hiratsuka (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/837,825

(22) Filed: Aug. 27, 2015

(65) Prior Publication Data

US 2016/0059566 A1 Mar. 3, 2016

(30) Foreign Application Priority Data

Aug. 29, 2014 (JP) ..... 2014-175512

(51) Int. Cl.
*B41J 2/14* (2006.01)

(52) U.S. Cl.
CPC .. *B41J 2/14233* (2013.01); *B41J 2002/14419* (2013.01); *B41J 2002/14459* (2013.01); *B41J 2202/12* (2013.01)

(58) Field of Classification Search
CPC .... B41J 2/04581; B41J 2/175; B41J 2/17513; B41J 2002/14306; B41J 2/18; B41J 2/19; B41J 2002/14419; B41J 2/17556; B41J 2002/14459; B41J 2202/12; B41J 2/14233; B41J 2/145; B41J 2/14
USPC ..... 347/68, 84, 85, 89, 92, 65, 70, 71, 40
See application file for complete search history.

(56) References Cited

U.S. PATENT DOCUMENTS

2005/0174392 A1* 8/2005 Shimizu ..... B41J 2/165 347/68
2011/0007117 A1* 1/2011 Bibl ..... B41J 2/14233 347/70

FOREIGN PATENT DOCUMENTS

JP 2012-532772 A 12/2012
JP 2014-4712 A 1/2014

* cited by examiner

*Primary Examiner* — Jannelle M Lebron
(74) *Attorney, Agent, or Firm* — Canon U.S.A., Inc. IP Division

(57) ABSTRACT

A liquid ejection head includes a liquid ejection substrate and a liquid reservoir. The liquid ejection substrate includes a plurality of liquid ejection sections. The liquid ejection sections include pressure chambers configured to hold liquid and ejection ports communicating with the pressure chambers. The pressure chambers each include a pressure unit configured to apply pressure to the liquid in each of the pressure chambers. The pressed liquid is ejected through the ejection ports. The liquid reservoir is in contact with a back of the liquid ejection substrate opposite to the ejection ports. The liquid reservoir is partitioned into at least one common liquid channel and a first common liquid chamber. The common liquid channel communicates with one of inlets and outlets of the plurality of pressure chambers. The first common liquid chamber communicates with another of the inlets and the outlets.

14 Claims, 8 Drawing Sheets

LIQUID EJECTION HEAD

BACKGROUND OF THE INVENTION

Field of the Invention

The present invention relates to a liquid ejection head that ejects liquid.

Description of the Related Art

Liquid ejection apparatuses that eject liquid such as ink to record images on a recording medium are generally equipped with a liquid ejection head that ejects liquid. Known examples of a mechanism for ejecting liquid from the liquid ejection head include a mechanism that uses a pressure chamber whose capacity can be varied with an piezoelectric element and a mechanism that uses a heating element that heats liquid to generate bubbles, thereby generating pressure. The pressure generated using these mechanisms causes the liquid in the pressure chamber to be ejected through ejection ports at an end of the pressure chamber. The pressure chamber is under a minute negative pressure. The negative pressure and the capillary action of the ejection ports are balanced to hold the interface of the liquid in the ejection ports.

It is known that the presence of bubbles in the pressure chamber significantly reduces the droplet ejection performance of liquid ejection heads. The bubbles in the pressure chamber are generated because of various factors including cavitation caused due to a pressure change during ejection and bubbles coming from a liquid supply channel. The bubbles in the pressure chamber are generally discharged using suction recovery, that is, by stopping printing, applying negative pressure to the ejection ports, with the ejection ports capped, and sucking the bubbles together with the liquid. However, the suction recovery, which needs to stop printing, reduces the production efficiency and wastes a large quantity of liquid. This is disadvantageous for commercial liquid ejection apparatuses that output high-quality images at a high speed in terms of time and cost.

PCT Japanese Translation Patent Publication No. 2012-532772 discloses a liquid ejection apparatus equipped with inflow channels and outflow channels in pressure chambers. Liquid is supplied to the pressure chambers through the inflow channels, part of which is ejected through ejection ports communicating with the pressure chambers, and the remaining liquid is discharged to the outflow channels. The discharging of the liquid to the outflow channels allows the liquid to be circulated, thus allowing bubbles and dust to be removed without stopping printing. This can also prevent the liquid from increasing in viscosity due to evaporation through the ejection ports. The pressure chambers, the inflow channels, and the outflow channels are provided for the individual ejection ports. The inflow channels communicate with a common liquid channel provided in common to each ejection port train. The outflow channels communicate with another common liquid channel provided in common to each ejection port train.

Liquid ejection heads designed to achieve high-resolution output are provided with ejection ports at high density. Therefore, in the liquid ejection apparatus disclosed in PCT Japanese Translation Patent Publication No. 2012-532772, the common liquid channel provided in common to each ejection port train is narrow and long. This causes a non-uniform pressure distribution in the common liquid channel due to channel resistance, exerting different negative pressures on the different pressure chambers, which may cause variations in ejection performance. Since the channel resistance depends on the viscosity of the liquid, larger variations in ejection performance can occur in printing with high-viscosity liquid, such as UV ink and solder paste, causing degradation of image quality.

SUMMARY OF THE INVENTION

The present invention provides a liquid ejection head including a liquid ejection substrate and a liquid reservoir. The liquid ejection substrate includes a plurality of liquid ejection sections. The liquid ejection sections include pressure chambers configured to hold liquid and ejection ports communicating with the pressure chambers. The pressure chambers each include a pressure unit configured to apply pressure to the liquid in each of the pressure chambers. The pressed liquid is ejected through the ejection ports. The liquid reservoir is in contact with a back of the liquid ejection substrate opposite to the ejection ports. The liquid reservoir is partitioned into at least one common liquid channel and a first common liquid chamber. The common liquid channel communicates with one of inlets and outlets of the plurality of pressure chambers. The first common liquid chamber communicates with another of the inlets and the outlets.

The liquid reservoir is partitioned into at least one common liquid channel and a first common liquid chamber. One of the inlets and the outlets of the plurality of pressure chambers communicates with the first common liquid chamber. In other words, one of the inlets and the outlets of the pressure chambers communicates with the first common liquid chamber without passing through the common liquid channel. This reduces the channel resistance at the inlets or the outlets of the pressure chambers communicating with the first common liquid chamber, reducing variations in ejection performance. The liquid is supplied to the pressure chambers through the common liquid channel and is discharged from the first common liquid chamber or is supplied from the first common liquid chamber to the pressure chamber and is discharged through the common liquid channel. This allows bubbles in the liquid to be discharged while executing printing.

Further features of the present invention will become apparent from the following description of exemplary embodiments with reference to the attached drawings.

DESCRIPTION OF THE EMBODIMENTS

Embodiments of the present invention will be described hereinbelow with reference to the drawings.

First Embodiment

Figure 1:
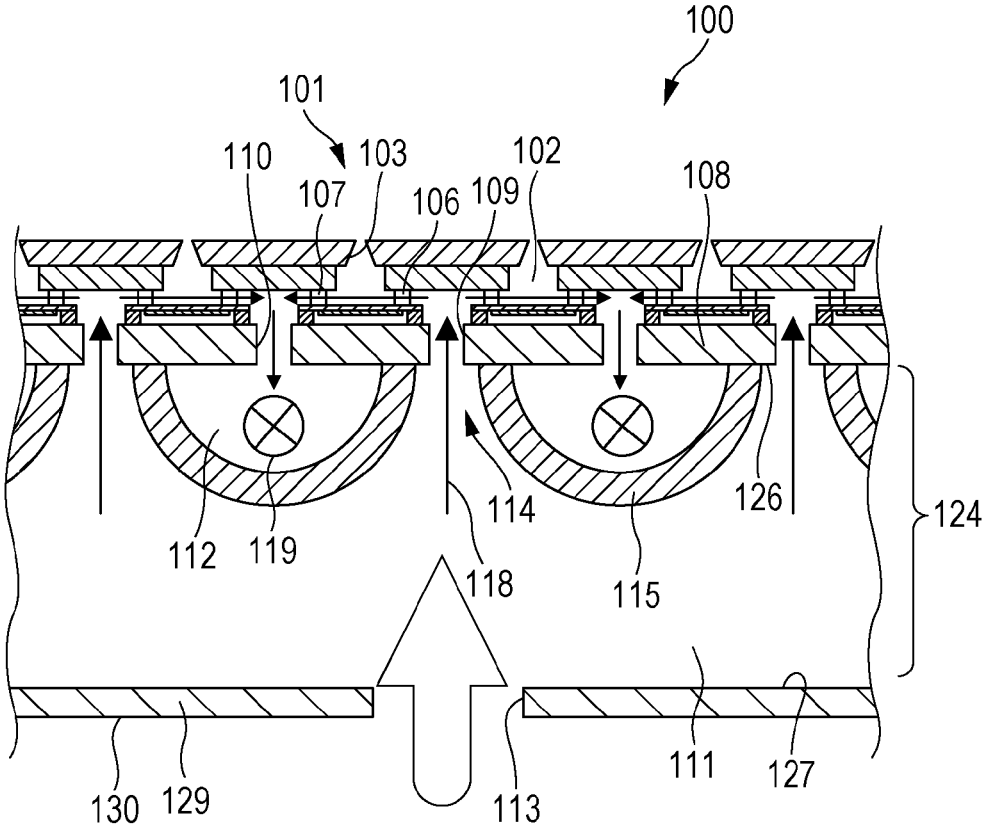
FIG. 1 is a schematic cross-sectional view of a liquid ejection head according to a first embodiment of the present invention.
Figure 2:
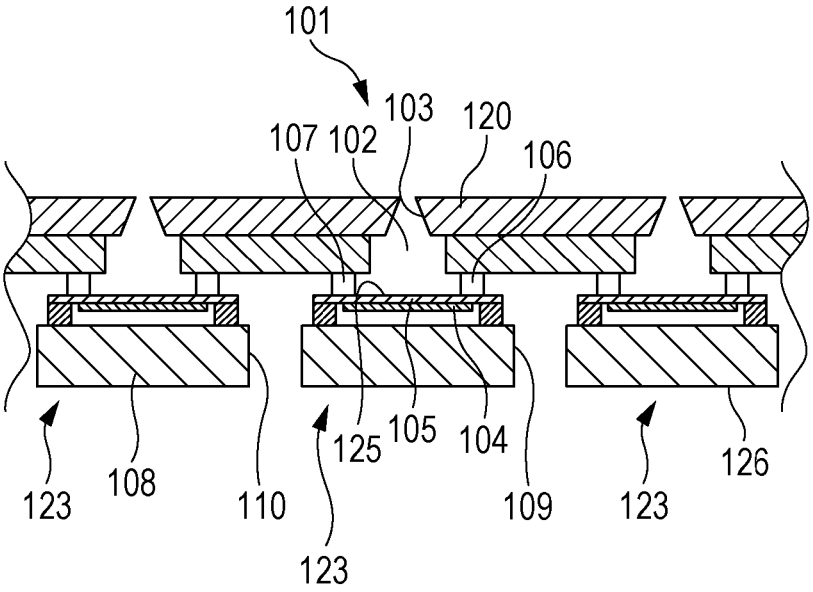
FIG. 2 is a schematic cross-sectional view of a liquid ejection substrate of the liquid ejection head shown in FIG. 1.

FIG. 1 is a schematic cross-sectional view of a liquid ejection head installed in a liquid ejection apparatus according to a first embodiment of the present invention. FIG. 2 is a schematic cross-sectional view of a liquid ejection substrate of the liquid ejection head. A liquid ejection head 100 includes a liquid ejection substrate 101. The liquid ejection substrate 101 has a plurality of liquid ejection sections 123 disposed in two dimensions. Each of the liquid ejection sections 123 includes a pressure chamber 102 having an ejection port 103, a piezoelectric element 104 to which a diaphragm 105 is bonded, a liquid supply channel 106, and a liquid recovery channel 107. The pressure chamber 102 temporarily holds liquid, such as ink, for use in printing. Each ejection port 103 corresponds to each individual pressure chamber 102 and communicates with the pressure chamber 102. The piezoelectric element 104 is a pressure device that presses liquid in the pressure chamber 102. The diaphragm 105 defines a bottom face 125 facing the ejection port 103 of the pressure chamber 102. The piezoelectric element 104 electrically connects to an individual electrode and a common electrode (not shown). These electrodes are electrically connected to wires (not shown) on a support substrate 108 with bumps (not shown). The wires on the support substrate 108 are led out to a control circuit (not shown) outside the liquid ejection head 100. The piezoelectric element 104 is deformed due to voltage supplied from the control circuit, and the diaphragm 105 boned to the piezoelectric element 104 deforms the pressure chamber 102 to apply pressure to the liquid in the pressure chamber 102. Part of the liquid in the pressure chamber 102, pressed by the diaphragm 105, is ejected through the ejection port 103. The liquid supply channel 106 communicates with an inlet of the pressure chamber 102 to allow the liquid to be supplied to the pressure chamber 102. The liquid recovery channel 107 communicates with an outlet of the pressure chamber 102 to allow the remaining of the liquid in the pressure chamber 102, which is not ejected through the ejection port 103, to be drained for recovery. The liquid supply channel 106 and the liquid recovery channel 107 have a larger inertial force than that of the ejection port 103 so that the pressure generated in the pressure chamber 102 is directed to the ejection port 103.

The support substrate 108 has a function of supporting the plurality of liquid ejection sections 123 while keeping the rigidity of the liquid ejection sections 123. The support substrate 108 has liquid-supply communication holes 109 each communicating with the liquid supply channel 106 and liquid-recovery communication holes 110 each communicating with the liquid recovery channel 107. The plurality of liquid-supply communication holes 109 allow the individual liquid supply channels 106 and a first common liquid chamber 111 to communicate with each other between adjacent common liquid channels 112. The plurality of liquid-recovery communication holes 110 allow the individual liquid recovery channels 107 and the common liquid channels 112 to communicate with each other. Accordingly, the support substrate 108 has a function of supplying liquid to the liquid ejection sections 123, a function of recovering the liquid from the liquid ejection sections 123, a function of supporting the array of liquid ejection sections 123, and a function of applying electrical control signals to the liquid ejection sections 123. Furthermore, the support substrate 108 defines a back 126 of the liquid ejection substrate 101 opposite to the ejection ports 103.

The liquid is supplied through the liquid supply channel 106 of the liquid ejection substrate 101, passes through the pressure chamber 102, and is recovered through the liquid recovery channel 107 to form a circulatory flow. When an electrical signal coming from the control circuit passes through the electrode of the support substrate 108 and is applied to the piezoelectric element 104, the diaphragm 105 is deformed. The piezoelectric element 104 deforms the bottom face 125 of the pressure chamber 102 in an out-of-plane direction via the diaphragm 105 to apply pressure to the liquid in the pressure chambers 102. Since the pressure chamber 102 is contracted and expanded, the pressure in the pressure chamber 102 is varied, and the liquid is ejected through the ejection port 103.

A liquid reservoir 124 is provided in contact with the back 126 of the liquid ejection substrate 101 opposite to the ejection port 103, that is, the back 126 of the support substrate 108. A surface of the support substrate 108 over which the liquid ejection ports 103 and the pressure chambers 102 communicating with the ejection ports 103 are disposed is sometimes referred to as a first surface, and the back 126 is sometimes referred to as a second surface. The liquid reservoir 124 is partitioned into at least one common liquid channel 112 and the first common liquid chamber 111. This embodiment includes a plurality of common liquid channels 112. The common liquid channels 112 are disposed parallel to each other in a direction in which the ejection ports 103 or the pressure chambers 102 are arrayed. The first common liquid chamber 111 and the common liquid channel 112 face the back 126 of the support substrate 108 or the liquid ejection substrate 101. If the pressure chambers 102, the first common liquid chamber 111, and the common liquid channels 112 are disposed on the same side of the support substrate 108, the distance from the pressure chambers 102 to the ejection ports 103 is long, thus reducing the ejection performance. Disposing the first common liquid chamber 111 and the common liquid channels 112 on the opposite side of the support substrate 108 with respect to the pressure chambers 102 leads to a decreased distance from the pressure chambers 102 to the ejection ports 103, thus improving the ejection performance.

A bottom face 127 of the first common liquid chamber 111 is defined by a second component member 129 so as to form a wide liquid reservoir below the back 126 of the support substrate 108 or the support substrate 108 in FIG. 1. The second component member 129 has a main supply port 113 on a bottom face 130 thereof. Liquid is supplied to the first common liquid chamber 111 through the main supply port 113. A common liquid channel member 115 is bonded to the back 126 of the support substrate 108. The common liquid channel member 115 and the support substrate 108 form each common liquid channel 112. Since the common liquid channel 112 is provided along the support substrate 108, alignment of the common liquid channel 112 and the liquid-recovery communication holes 110 is facilitated. This allows the common liquid channel 112 to be reliably supported by the support substrate 108 even if the common liquid channel member 115 is made of a low-rigidity material, such as resin. The common liquid channels 112 are formed along the array of liquid ejection sections 123 and extend in a direction perpendicular to the plane of FIG. 1. This allows the liquid in the liquid ejection sections 123 to be recovered to the common liquid channels 112 via the plurality of liquid-recovery communication holes 110 connected to the corresponding common liquid channels 112. The space between the adjacent common liquid channels 112 in the liquid reservoir 124 serves as a common liquid supply section 114. The common liquid supply section 114 in the first common liquid chamber 111 is connected to each liquid-supply communication hole 109. The liquid in the first common liquid chamber 111 flows upwards in FIG. 1 and is supplied to the individual liquid ejection sections 123 through the liquid-supply communication holes 109.

Figure 3:
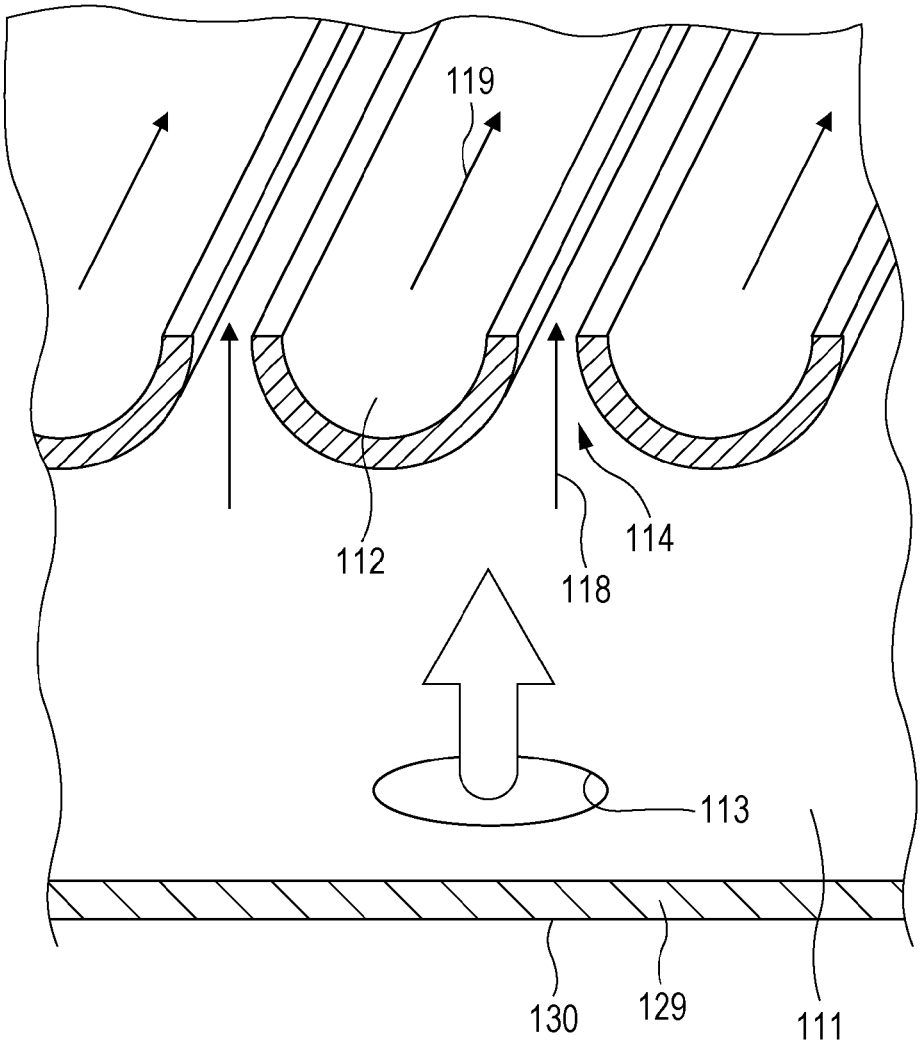
FIG. 3 is a diagram illustrating the flow of liquid in the liquid ejection head shown in FIG. 1.
Figure 4:
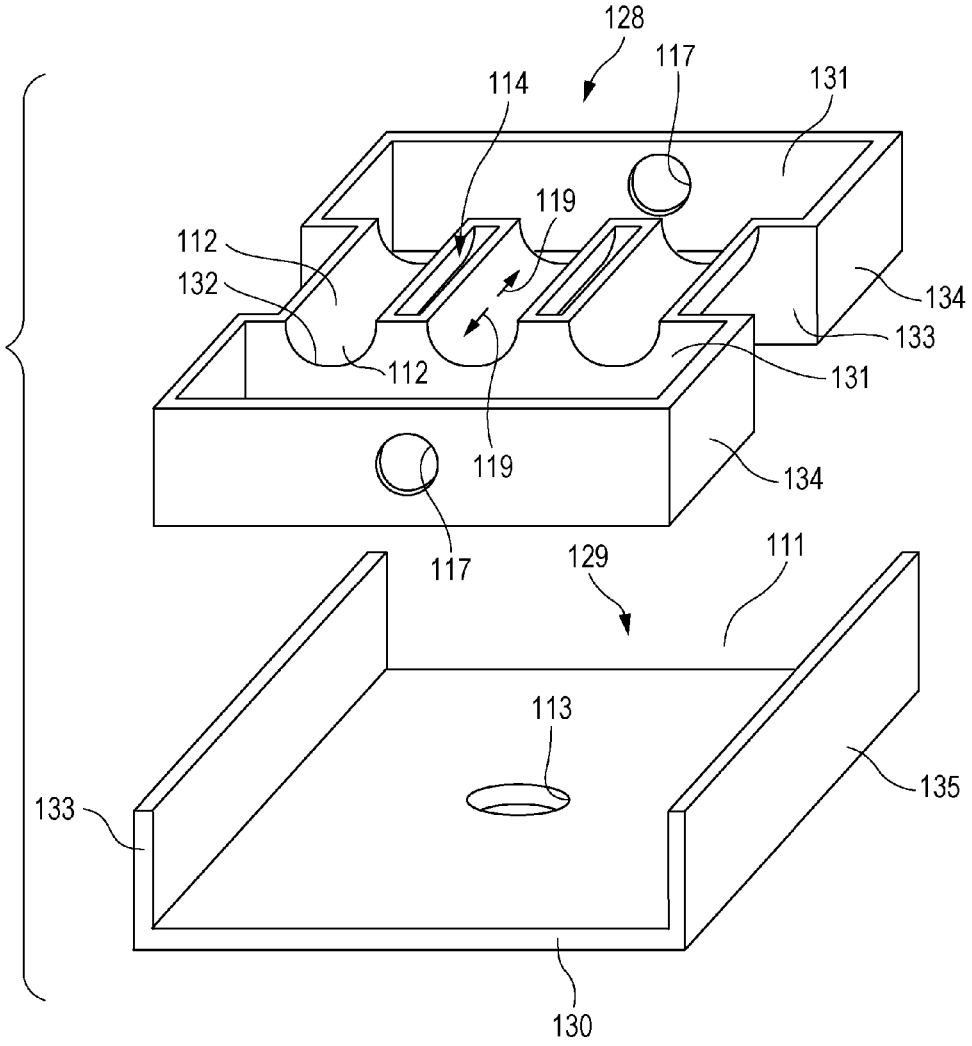
FIG. 4 is an exploded perspective view of component members of first and second common liquid chambers and common liquid channels.

FIG. 3 is a diagram illustrating the flow of the liquid in the common liquid supply sections 114 and the common liquid channels 112. FIG. 4 is an exploded perspective view of component members forming the first common liquid chamber 111 and the common liquid channels 112. Liquid 118 is subjected to deaeration and filtering, is controlled to a desired negative pressure, and is supplied to the first common liquid chamber 111 through the main supply port 113. Since the liquid 118 to be supplied to the liquid ejection sections 123 is supplied through the common liquid supply sections 114 between the common liquid channels 112, as shown in FIG. 3, the channel length is short, thus decreasing the channel resistance irrespective of the number of arrays of the liquid ejection sections 123. The common liquid channel 112 has a semicircular cross-section whose chord is the back 126 of the liquid ejection substrate 101. This can further reduce the channel resistance of the common liquid supply sections 114.

Referring to FIG. 4, the liquid ejection head 100 includes second common liquid chambers 131 communicating with the plurality of common liquid channels 112. Although the second common liquid chambers 131 are provided on both sides of the liquid ejection sections 123, only one second common liquid chamber 131 may be provided depending on the number of arrays of the liquid ejection sections 123 or the ejection ports 103. Liquid 119 recovered from the liquid ejection sections 123 passes through the liquid-recovery communication holes 110 of the plurality of liquid ejection sections 123 and the common liquid channels 112 into the second common liquid chambers 131 and is recovered through main recovery ports 117 of the second common liquid chambers 131. Since the common liquid channels 112 extend parallel to each other along the array of the liquid ejection sections 123 or the ejection ports 103, the number of the common liquid channels 112 can be reduced. Since the main recovery ports 117 are controlled to a lower negative pressure than that of the main supply port 113, the liquid circulates from the main supply port 113 through the liquid ejection sections 123 to the main recovery ports 117 due to a difference in pressure set for the ports 113 and 117. The length of channels of the liquid 119 to be recovered, specifically, the common liquid channels 112, increases as the number of arrays of the liquid ejection sections 123 or the ejection ports 103 increases, and thus the channel resistance increases. However, since the first common liquid chamber 111 is sufficiently large, and the channel resistance of the common liquid supply sections 114 is small, the negative pressure applied to the individual liquid ejection sections 123 is substantially equal to the pressure in the first common liquid chamber 111. This leads to little difference (variation) in negative pressure between the liquid ejection sections 123, providing uniform ejection performance to the liquid ejection sections 123. In this embodiment, the liquid 118 is supplied from one common liquid supply section 114 to two arrays of liquid ejection sections 123, and the liquid 119 is recovered from the two arrays pf liquid ejection sections 123 or ejection ports 103 to one common liquid channel 112. This allows the common liquid channel 112 to be increased in size, allowing the channel resistance of the common liquid channel 112 to be decreased.

As shown in FIG. 4, the liquid ejection head 100 includes a first component member 128 and a second component member 129. The first component member 128 constitutes grooves 132 of the individual common liquid channels 112, the common liquid supply sections 114 each provided between the common liquid channels 112, part of side walls 133 of the first common liquid chamber 111, and side walls 134 of the second common liquid chambers 131. The second component member 129 constitutes a bottom face 130 of the first and second common liquid chambers 111 and 131 and the remaining of the side walls 133 of the first common liquid chamber 111. The second component member 129 has a structure in which the main supply port 113 for supplying the liquid 118 is provided in the bottom face 130, and side surfaces 135 erect. Combining the first component member 128 and the second component member 129 forms the first common liquid chamber 111 and the second common liquid chamber 131. Since the channels can be formed in such a simple structure, the liquid ejection head 100 can be produced at low cost.

As described above, the channel resistance of the common liquid supply section 114 can be reduced by proving the common liquid channels 112 in the liquid reservoir 124. Variations in ejection performance can be reduced by making the pressure in the plurality of liquid ejection sections 123 uniform.

Figure 5:
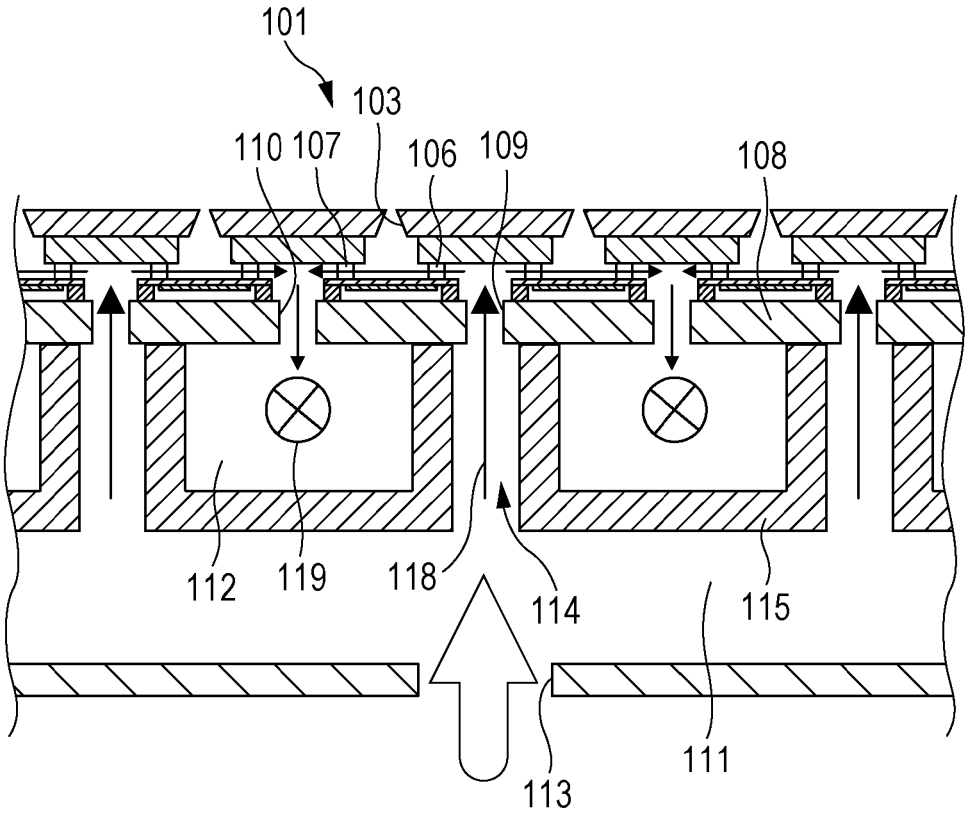
FIG. 5 is a schematic cross-sectional view of a liquid ejection head including rectangular-cross-section common liquid channels.

The cross-sectional shape of the common liquid channels 112 is not limited to the semicircular shape but may be a tapered shape that increases in width toward the back 126 of the liquid ejection substrate 101, such as a semiellipse and a triangle. The semiellipse is half of an ellipse, which is obtained by cutting the ellipse along the major axis or the minor axis of the ellipse. The major axis or the minor axis of the cross-section of the semielliptical common liquid channel 112 is in contact with the back 126 of the liquid ejection substrate 101. A triangular-cross-section common liquid channel 112 is in contact with the back 126 of the liquid ejection substrate 101 at one side. The cross-sectional shape of the common liquid channel 112 may be a trapezoid whose long side or short side is in contact with the back 126 of the liquid ejection substrate 101. All of the shapes allow the channel resistance of the common liquid supply section 114 to be reduced. As shown in FIG. 5, the common liquid channel 112 may be rectangular in cross-section. The rectangle may be any rectangle including a square, an oblong, and a rhombus. In this case, one of the four sides is in contact with the back 126 of the liquid ejection substrate 101. With the rectangular-cross-section common liquid channels 112, the channel resistance of the common liquid supply section 114 is higher than that with the semicircular-cross-section common liquid channels 112. However, the supplied liquid 118 flows upwards therein, allowing the channel resistance of the common liquid supply section 114 to be sufficiently reduced. Furthermore, the rectangular-cross-section common liquid channels 112 have a larger cross-sectional area than that with the semicircular-cross-section common liquid channels 112 with the same height, allowing the channel resistance of the common liquid supply section 114 to be reduced.

Figure 6:
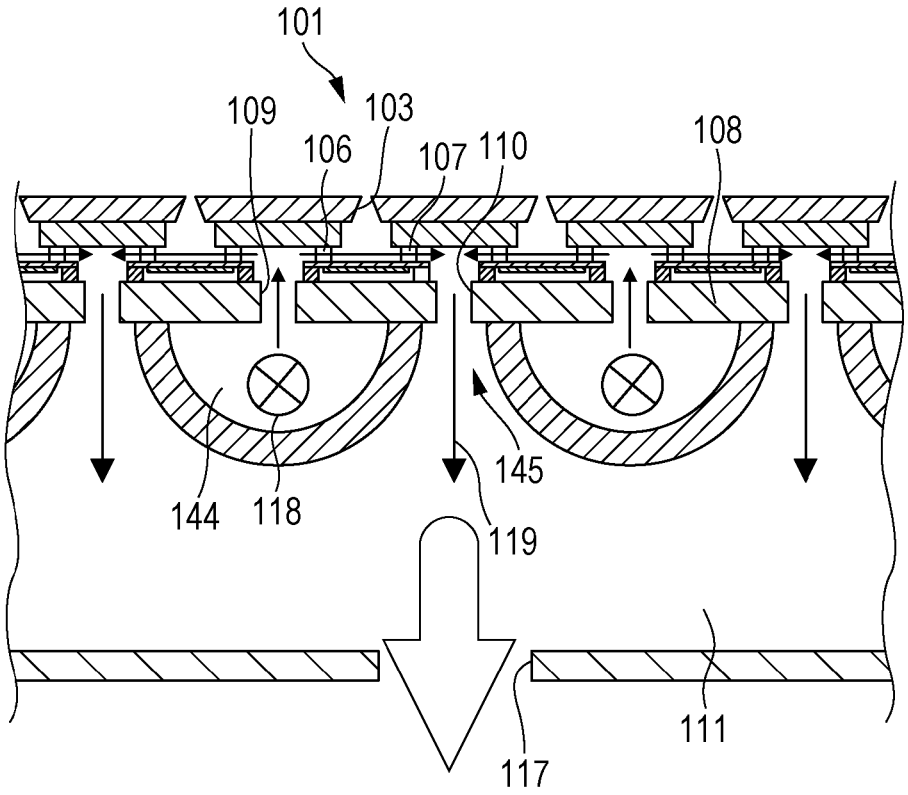
FIG. 6 is a schematic cross-sectional view of the liquid ejection head in which liquid circulates in an opposite direction to that in FIG. 2.

In this embodiment, the channel resistance of the common liquid supply section 114 can be reduced; instead, the channel resistance of a common liquid recovery section 145 may be reduced. FIG. 6 illustrates a schematic cross-sectional view of the liquid ejection head 100 in which the circulatory flow of the liquid is opposite to that in the above embodiment. Common liquid channels 144 are provided instead of the common liquid channels 112, and common liquid recovery sections 145 are provided instead of the common liquid supply sections 114. The positions of the main supply port 113 and the main recovery port 117 are interchanged. Liquid is supplied through the main supply port 113, the second common liquid chambers 131, and the common liquid channel 144 to the liquid ejection sections 123 and is recovered through the common liquid recovery sections 145, the first common liquid chamber 111, and the main recovery ports 117. This configuration causes a non-uniform pressure distribution due to the channel resistance of the common liquid channels 144. The pressures in the individual liquid ejection sections 123 can be controlled with the first common liquid chamber 111. This allows the pressure to be made uniform as in the embodiment shown in FIGS. 1 to 4, reducing variations in ejection performance.

As described above, in this embodiment, the common liquid channels 112 (or 144) communicate with one of the inlet and the outlet of the plurality of pressure chambers 102, and the first common liquid chamber 111 communicates with the other. In other words, the common liquid chamber (liquid reservoir) 124 communicating with one of the inlet and the outlet of the plurality of pressure chambers 102 is disposed, and the common liquid channels 112 communicating with the other are disposed in the common liquid chamber 124. By reducing the channel resistance of one of the inlet and the outlet of the pressure chambers 102, the pressure in the pressure chambers 102 of the individual liquid ejection sections 123 can be made uniform even in a liquid ejection head in which ejection ports are disposed at high density. Furthermore, in this embodiment, the channel resistance of the common liquid supply sections 114 (or the common liquid recovery sections 145) can be made low. The channel resistance at the inlet and the outlet of the pressure chambers 102 can be made low by relatively increasing the size of the common liquid channels 112 (or 144).

Second Embodiment

Figure 7:
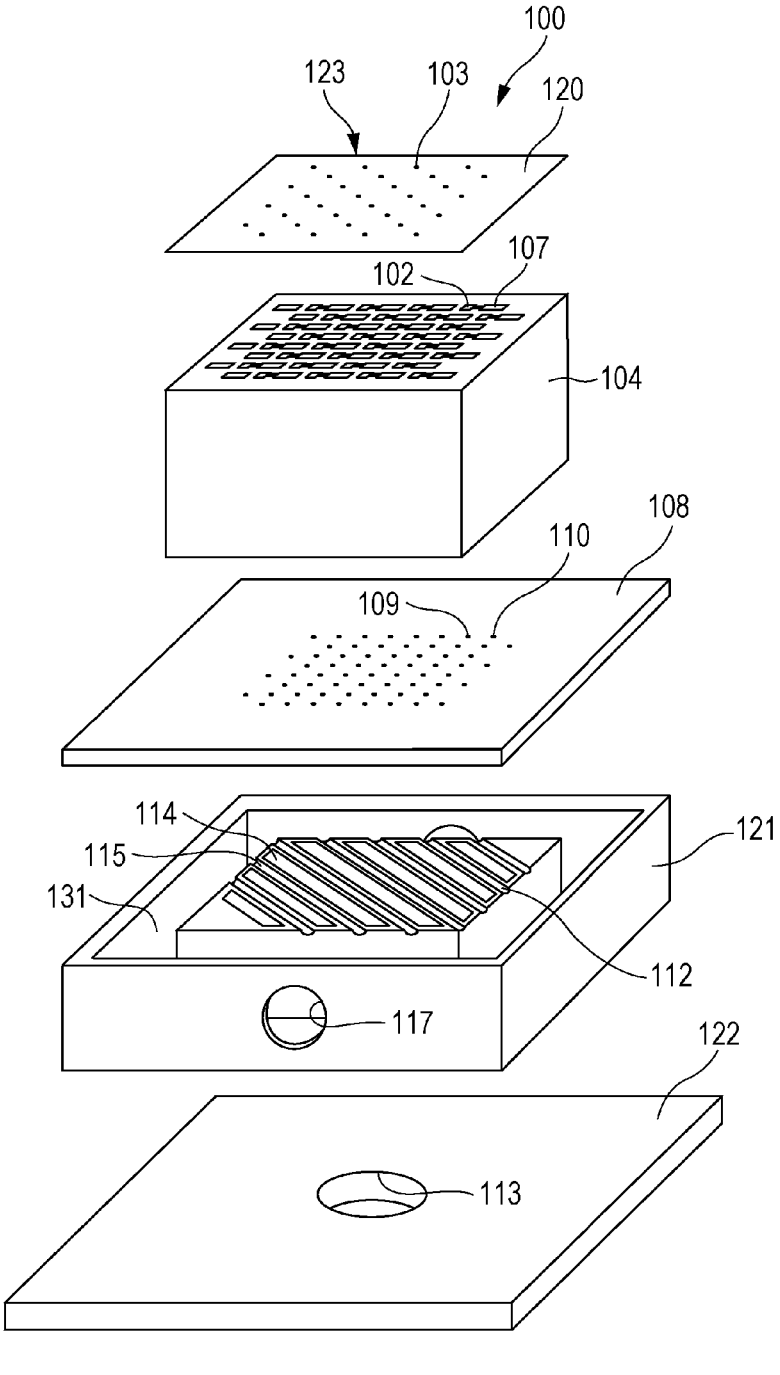
FIG. 7 is an exploded perspective view of a Gould's liquid ejection head according to an embodiment of the present invention.
Figure 8:
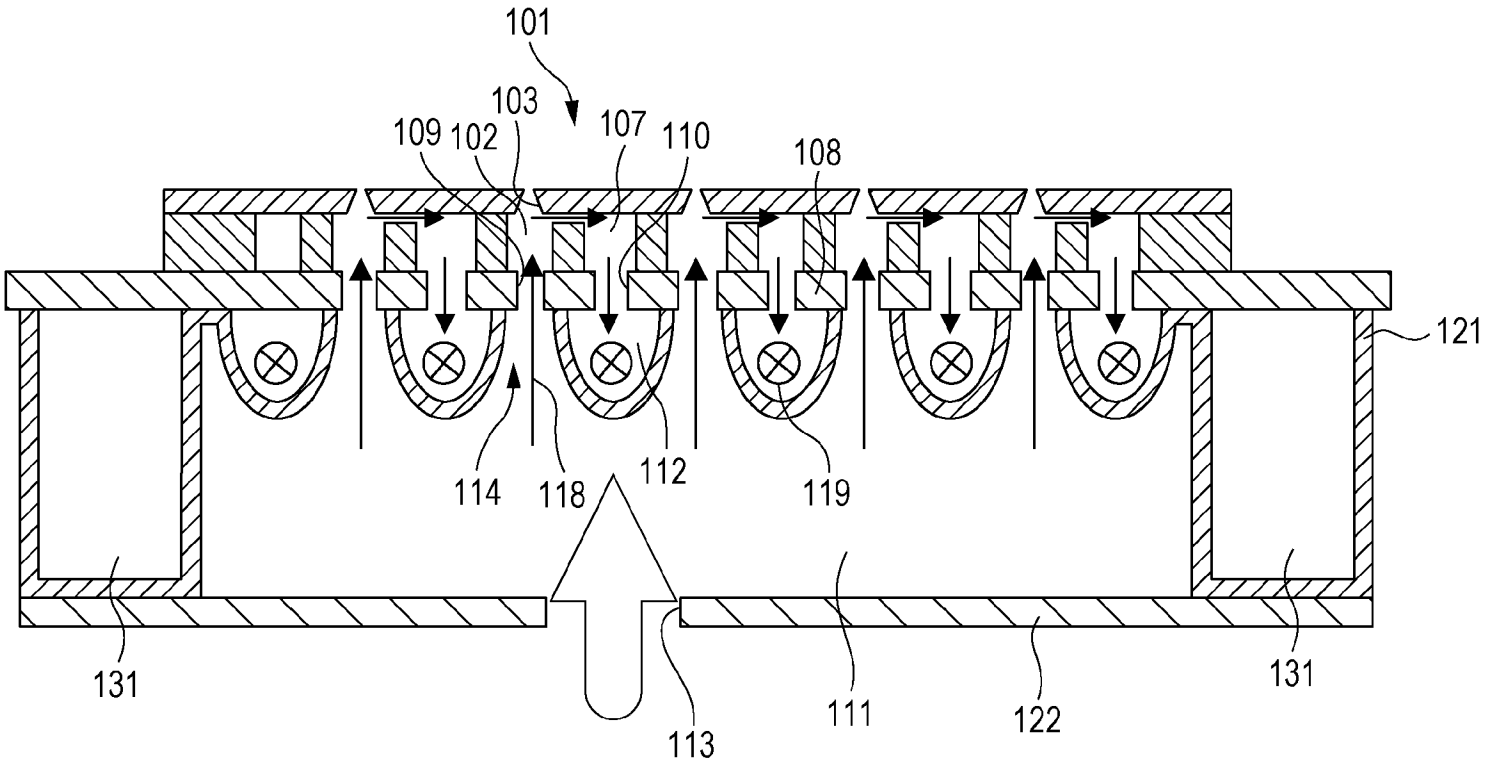
FIG. 8 is a schematic cross-sectional view of the Gould's liquid ejection head.

The present invention can also be applied to a Gould's liquid ejection head, that is, a liquid ejection head in which pressure chambers are surrounded by a piezoelectric material, and pressure is applied to liquid in the pressure chamber due to the extension and retraction in a radial direction of the pressure chamber. FIG. 7 is an exploded perspective view of a Gould's liquid ejection head according to an embodiment of the present invention. FIG. 8 is a schematic cross-sectional view of the same.

A liquid ejection head 100 includes an ejection-port formed member 120 having ejection ports 103 and a piezoelectric element 104 including pressure chambers 102 and liquid recovery channels 107. The pressure chambers 102 have the shape of a tube or a column communicating with the ejection ports 103 at one end and communicating with the first common liquid chamber 111 at the other end. In this embodiment, the liquid in the pressure chambers 102 is pressed by the piezoelectric element 104 including the pressure chambers 102 and deforming the side surfaces of the pressure chambers 102 in an out-of-plane direction. The pressure chambers 102 and the ejection ports 103 constitute the liquid ejection sections 123. The ejection-port formed member 120, the piezoelectric element 104, the support substrate 108, a structure 121, and a main supply port plate 122 are stacked in sequence. The support substrate 108 has the liquid-supply communication holes 109 and the liquid-recovery communication holes 110. The structure 121 has the common liquid channels 112 and the common liquid supply sections 114. The main supply port plate 122 has the main supply port 113. The main supply port plate 122 is joined to the structure 121 to form the first common liquid chamber 111.

The liquid ejection head 100 includes the pressure chambers 102 for temporarily holding liquid, the ejection ports 103 provided or the corresponding pressure chambers 102, and the liquid recovery channels 107 for recovering the liquid. One end of the liquid recovery channels 107 communicates with the pressure chambers 102 in the vicinity of the ejection ports 103, and the other end communicates with the common liquid channels 112. The piezoelectric element 104 surrounds the pressure chambers 102 cylindrically and has individual electrodes (not shown) for the individual liquid ejection sections 123 on the inner surface and a common electrode (not shown) common to all the liquid ejection sections 123 on the outer surface. By applying voltage to the electrodes, the piezoelectric element 104 is deformed to contract the pressure chambers 102. These electrodes are connected to electrical wires (not shown) of the support substrate 108 and are supplied with control voltage signals. A detailed configuration of this type of head and a method for driving it are disclosed in Japanese Patent Laid-Open No. 2014-4712.

The liquid supplied through the main supply port 113 passes through the first common liquid chamber 111, the common liquid supply sections 114 in the structure 121, and the liquid-supply communication holes 109 and is supplied to the individual pressure chambers 102. Part of the liquid in the pressure chambers 102 is ejected through the ejection ports 103. The remaining liquid passes through the liquid recovery channels 107 and the liquid-recovery communication holes 110 into the common liquid channels 112 common to the plurality of liquid-recovery communication holes 110, passes through the second common liquid chamber 131, and is recovered through the main recovery ports 117. The common liquid channels 112 are provided along the diagonally extending ejection port trains for the individual ejection port trains.

As shown in FIG. 8, the first common liquid chamber 111 is provided below the common liquid channels 112 in the structure 121. The bottom of the first common liquid chamber 111 is defined by the main supply port plate 122. The common liquid supply sections 114 are each provided between the adjacent common liquid channels 112. Since the supplied liquid 118 flows upwards, as in the first embodiment, the channel resistance can be reduced. Since the structure 121 has a shape that can be produced using injection molding, and the first common liquid chamber 111 can be formed only by bonding the structure 121 to the main supply port plate 122, the liquid ejection head of this embodiment can be produced at low cost.

The present invention can also be applied to the Gould's liquid ejection head and to a liquid ejection head whose ejection ports are arrayed in a diagonal direction. Also in this embodiment, liquid circulation channels can be formed without causing a non-uniform pressure distribution in the common liquid supply sections.

As described above, the present invention provides a liquid ejection head which is capable of discharging bubbles in the liquid while executing printing and in which the channel resistance is reduced so that variations in ejection performance can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175512, filed Aug. 29, 2014, which is hereby incorporated by reference herein in its entirety.

What is claimed is:

1. A liquid ejection head comprising:

a liquid ejection substrate including a plurality of liquid ejection sections including pressure chambers configured to hold liquid at a negative pressure and ejection ports communicating with the pressure chambers, the pressure chambers each including a pressure unit configured to apply pressure to the liquid in each of the pressure chambers, the pressed liquid being ejected through each of the ejection ports; and a liquid reservoir on a back of the liquid ejection substrate opposite to a side on which the ejection ports are provided, wherein the liquid reservoir is partitioned into:

a common liquid chamber to hold the liquid at a negative pressure substantially equal to the negative pressure of the liquid ejection sections, and a plurality of common liquid channels extending parallel to each other and each provided by a wall in the common liquid chamber to separate the common liquid channel from the common liquid chamber, wherein the plurality of common liquid channels each communicate with the pressure chambers, the plurality of common liquid channels communicate with one set of the inlets and the outlets of the plurality of pressure chambers, and the common liquid chamber communicates with another set of the inlets and the outlets of the plurality of pressure chambers, wherein the another set is different than those being communicated with by the plurality of common liquid channels.

2. The liquid ejection head according to claim 1, wherein the liquid ejection head further comprises a second common liquid chamber communicating with the plurality of common liquid channels.

3. The liquid ejection head according to claim 2, further comprising:

a first component member constituting of a groove of each of the plurality of common liquid channels, part of a side wall of the first common liquid chamber, and a side wall of the second common liquid chamber; and a second component member constituting a remaining of the side wall of the first common liquid chamber and a bottom face of the first and second common liquid chambers.

4. The liquid ejection head according to claim 1, wherein each of the plurality of common liquid channels has a semicircular cross-section whose chord is the back of the liquid ejection substrate.

5. The liquid ejection head according to claim 1, wherein each common liquid channel of the plurality of common liquid channels has a tapered cross-section increasing in width toward the back of the liquid ejection substrate.

6. The liquid ejection head according to claim 1, wherein each common liquid channel of the plurality of common liquid channels has a rectangular cross-section.

7. The liquid ejection head according to claim 1, wherein each common liquid channel of the plurality of common liquid channels extends in a direction in which the ejection ports are arrayed.

8. The liquid ejection head according to claim 1, wherein the liquid ejection substrate includes a plurality of liquid supply channels configured to supply the liquid to the plurality of pressure chambers, a plurality of liquid recovery channels configured to recover the liquid from the plurality of pressure chambers, a plurality of liquid-supply communication holes communicating between the liquid supply channels and the common liquid channels, and a plurality of liquid-recovery communication holes communicating between the liquid recovery channels and the first common liquid chamber between the common liquid channels adjacent to each other.

9. The liquid ejection head according to claim 1, wherein the liquid ejection substrate includes a plurality of liquid supply channels configured to supply the liquid to the plurality of pressure chambers, a plurality of liquid recovery channels configured to recover the liquid from the plurality of pressure chambers, a plurality of liquid-supply communication holes communicating between the liquid supply channels and the first common liquid chamber between the common liquid channels adjacent to each other, and a plurality of liquid-recovery communication holes communicating between the liquid recovery channels and the common liquid channels.

10. The liquid ejection head according to claim 1, wherein the pressure unit comprises a piezoelectric element in the vicinity of a bottom face of the pressure chamber facing the ejection port, the piezoelectric element deforming the bottom face in an out-of-plane direction.

11. The liquid ejection head according to claim 10, wherein a train of each common liquid channel of the plurality of common liquid channels is disposed for two arrays of the ejection ports.

12. The liquid ejection head according to claim 1, wherein the pressure chamber has a tubular or cylindrical shape communicating with the ejection port at a first end and communicating with the common liquid chamber at a second end;

the liquid is supplied from the second end to the pressure chamber;

the liquid ejection substrate includes a plurality of liquid recovery channels each communicating with the pressure chamber at a first end near the ejection port and communicating with the common liquid channel at a second end; and the pressure unit comprises a piezoelectric element including the pressure chamber and deforming a side surface of the pressure chamber in an out-of-plane direction.

13. The liquid ejection head according to claim 1, wherein the plurality of common liquid channels are connected with the first common liquid chamber only via the pressure chamber.

14. A liquid ejection head comprising:

a liquid ejection substrate including a plurality of liquid ejection sections including pressure chambers configured to hold liquid and ejection ports communicating with the pressure chambers, the pressure chambers each including a pressure unit configured to apply pressure to the liquid in each of the pressure chambers, the pressed liquid being ejected through each of the ejection ports; and a liquid reservoir on a back of the liquid ejection substrate opposite to a side on which the ejection ports are provided, wherein the liquid reservoir is partitioned into:

a common liquid chamber, and a plurality of common liquid channels extending parallel to each other and each provided by a wall in the common liquid chamber to separate the common liquid channel from the first common liquid chamber, wherein the plurality of common liquid channels communicate with the pressure chambers, the plurality of common liquid channels communicate with one set of the inlets and the outlets of the plurality of pressure chambers, and the common liquid chamber communicates with another set of the inlets and the outlets of the plurality of pressure chambers, wherein the another set is different than those being communicated with by the plurality of common liquid channels.

* * * * *